US010163559B2

(12) United States Patent
Igarashi et al.

(10) Patent No.: US 10,163,559 B2
(45) Date of Patent: Dec. 25, 2018

(54) COIL COMPONENT

(71) Applicant: MURATA MANUFACTURING CO., LTD., Kyoto-fu (JP)

(72) Inventors: Akio Igarashi, Nagaokakyo (JP); Takashi Murakami, Nagaokakyo (JP); Koji Onishi, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 10 days.

(21) Appl. No.: 15/470,394

(22) Filed: Mar. 27, 2017

(65) Prior Publication Data

US 2017/0316873 A1 Nov. 2, 2017

(30) Foreign Application Priority Data

Apr. 28, 2016 (JP) ..... 2016-090526

(51) Int. Cl.

| | |
|---|---|
| ***H01F 27/29*** | (2006.01) |
| ***H01F 17/04*** | (2006.01) |
| *H01F 27/28* | (2006.01) |
| *H01F 3/10* | (2006.01) |
| *H01F 17/00* | (2006.01) |

(52) U.S. Cl.

CPC ..... *H01F 27/292* (2013.01); *H01F 17/045* (2013.01); *H01F 27/2828* (2013.01); *H01F 3/10* (2013.01); *H01F 27/2823* (2013.01); *H01F 2017/0093* (2013.01)

(58) Field of Classification Search

CPC ..... H01F 27/292; H01F 17/045; H01F 27/24; H01F 27/2823

USPC ..... 336/65, 83, 90, 192, 208

See application file for complete search history.

(56) References Cited

U.S. PATENT DOCUMENTS 4,361,823 A * 11/1982 Philberth ..... H01F 27/245 336/212
2006/0071749 A1* 4/2006 Aoki ..... H01F 17/045 336/83

(Continued)

FOREIGN PATENT DOCUMENTS

DE 10 2011 116 410 A1 4/2012
JP 2004079640 A * 3/2004
JP 2005-340621 A 12/2005

(Continued)

OTHER PUBLICATIONS

An Office Action issued by the German Patent Office dated Dec. 14, 2017, which corresponds to German Patent Application No. 10 2017 207 021.8.

(Continued)

*Primary Examiner* — Tsz Chan

(74) *Attorney, Agent, or Firm* — Studebaker & Brackett PC

(57) ABSTRACT

A terminal electrode includes a base extending along the outer end face of a flange, a mounting part extending from the base along the bottom face of the flange via a first bending part that covers the edge portion where the outer end face and the bottom face meet, and a wire connection part extending from the base along a substantially horizontal face via a second bending part that covers the edge portion where the outer end face and the substantially horizontal face meet, the wire connection part being electrically connected to an end portion of a wire.

4 Claims, 8 Drawing Sheets

(56) References Cited

U.S. PATENT DOCUMENTS

| | | | | |
|---|---|---|---|---|
| 2006/0267719 | A1* | 11/2006 | Yasuda | H01F 17/045 336/223 |
| 2008/0003864 | A1* | 1/2008 | Hatakeyama | H01F 17/045 439/399 |

FOREIGN PATENT DOCUMENTS

| | | | | | |
|---|---|---|---|---|---|
| JP | 2007-150032 | A | | 6/2007 | |
| JP | 2007-258201 | A | | 10/2007 | |
| JP | 2008-10752 | A | | 1/2008 | |
| JP | 2012089804 | A | * | 5/2012 | H01F 17/06 |
| JP | 5156076 | B2 | | 3/2013 | |
| JP | 2014099586 | A | * | 5/2014 | |
| JP | 2014216347 | A | * | 11/2014 | |

OTHER PUBLICATIONS

An Office Action; "Notification of Reasons for Refusal," Mailed by the Japanese Patent Office dated Oct. 16, 2018, which corresponds to Japanese Patent Application No. 2016-090526 and is related to U.S. Appl. No. 15/470,394; with English language translation.

* cited by examiner

COIL COMPONENT

CROSS REFERENCE TO RELATED APPLICATIONS

This application claims benefit of priority to Japanese Patent Application 2016-090526 filed Apr. 28, 2016, the entire content of which is incorporated herein by reference.

TECHNICAL FIELD

The present disclosure relates to a coil component. More specifically, the present disclosure relates to a coil component that includes a substantially drum-shaped core having a core part on which a wire is wound, a flange provided on an end portion of the core part, and a terminal electrode electrically connected to an end portion of the wire, the terminal electrode being fixed to the flange.

BACKGROUND

An example of a technique that is of interest for the present disclosure is described in Japanese Patent No. 5156076. A coil component 100 described in Japanese Patent No. 5156076 will be described with reference to FIGS. 6 to 9.

The coil component 100 includes a substantially drum-shaped core 1, and two wires 2 and 3. The wires 2 and 3 are each formed of, for example, a copper wire with an insulating coating. The substantially drum-shaped core 1 has a core part 4, and first and second flanges 5 and 6 each provided in an end portion of the core part 4.

The first flange 5 has an inner end face 7 facing toward the core part 4 and where each end portion of the core part 4 is positioned, an outer end face 9 located opposite to the inner end face 7 and facing outward, a bottom face 11 that connects the inner end face 7 with the outer end face 9 and is oriented toward a mount board when the coil component 100 is mounted onto the mount board, a top face 13 located opposite to the bottom face 11, and first and second side faces 15 and 17 that extend so as to connect the bottom face 11 with the top face 13 and are opposite to each other.

Like the first flange 5, the second flange 6 has an inner end face 8 facing toward the core part 4 and where each end portion of the core part 4 is positioned, an outer end face 10 located opposite to the inner end face 8 and facing outward, a bottom face 12 that connects the inner end face 8 with the outer end face 10 and is oriented toward the mount board when the coil component 100 is mounted onto the mount board, a top face 14 located opposite to the bottom face 12, and first and second side faces 16 and 18 that extend so as to connect the bottom face 12 with the top face 14 and are opposite to each other.

The first flange 5 has depressions 19 and 20 in the form of cutouts, and the second flange 6 has depressions 21 and 22 in the form of cutouts. Although the depression 21 located at a position of the second flange 6 opposite to the depression 22 is not depicted, the depression 21 is designated by reference sign "21" for the convenience of explanation.

As a representative example of the depressions 19 to 22, the depression 22 illustrated in enlarged view in FIG. 9 will be described below. In the second flange 6, the depression 22 is located in an end portion of the second side face 18 near the bottom face 12. The depression 22 is in the form of a cutout defined by a substantially horizontal face 23 extending along the bottom face 12 and a substantially vertical face 24 extending along the side face 18. In the second flange 6, the depression 21 (not illustrated) is located in an end portion of the first side face 16 near the bottom face 12. The depression 21 is in the form of a cutout defined by a substantially horizontal face extending along the bottom face 12 and a substantially vertical face extending along the side face 16.

Likewise, in the first flange 5, the depression 19 is located in an end portion of the first side face 15 near the bottom face 11. The depression 19 is in the form of a cutout defined by a substantially horizontal face extending along the bottom face 11 and a substantially vertical face extending along the side face 15. In the first flange 5, the depression 20 is located in an end portion of the second side face 17 near the bottom face 11. The depression 20 is in the form of a cutout defined by a substantially horizontal face extending along the bottom face 11 and a substantially vertical face extending along the side face 17.

Two terminal electrodes, a first terminal electrode 25 and a third terminal electrode 27, are fixed to the first flange 5 by using an adhesive. Two terminal electrodes, a second terminal electrode 26 and a fourth terminal electrode 28, are fixed to the second flange 6 by using an adhesive. Although the terminal electrode 26 is not illustrated in FIG. 6, reference sign "26" is used to designate the terminal electrode 26 for the convenience of explanation. One end portion of the first wire 2 is connected to the first terminal electrode 25 provided in the first flange 5. The other end portion of the first wire 2 is connected to the second terminal electrode 26 provided in the second flange 6. One end portion of the second wire 3 is connected to the third terminal electrode 27 provided in the first flange 5. The other end portion of the second wire 3 is connected to the fourth terminal electrode 28 provided in the second flange 6.

The terminal electrodes 25 to 28 have substantially identical or symmetric shapes. Among these terminal electrodes, the terminal electrode 28 will be described as a representative example with reference to FIG. 8. The terminal electrode 28 includes a base 29 extending along the outer end face 9 of the flange 5, and a mounting part 31 extending along the bottom face 11 of the flange 5 via a first bending part 30 that covers an edge portion where the outer end face 9 and the bottom face 11 of the flange 5 meet. The terminal electrode 28 further has a wire holding part 33 that extends from the mounting part 31 via a second bending part 32, and a wire welding part 35 that extends from the base 29.

The mounting part 31 and the wire holding part 33 are well depicted also in FIG. 9. As illustrated in FIG. 9, the wire holding part 33 is located within the depression 22. An end portion of the wire 3 is positioned with respect to the wire welding part 35. To maintain this state, the wire holding part 33 is bent as illustrated in FIG. 9. This causes the portion near an end portion of the wire 3 to become embraced and held by the wire holding part 33. Then, the end portion of the wire 3, and the wire welding part 35 are subjected to laser welding to electrically connect the wire 3 with the terminal electrode 28. In FIG. 6, a weld ball 36 formed as a result of the laser welding is illustrated to be located near each of the terminal electrodes 25 and 27.

The above description about the terminal electrode 28 equally applies to the other terminal electrodes 25 to 27.

The coil component 100 illustrated in FIG. 6 further includes a plate core 37 that is passed between the pair of flanges 5 and 6 with its one principal face being in contact with the respective top faces 13 and 14 of the first and second flanges 5 and 6. If the substantially drum-shaped core 1 and the plate core 37 are both made of a magnetic material such as ferrite, the substantially drum-shaped core 1 and the plate core 37 form a closed magnetic circuit.

SUMMARY

Since a description of the terminal electrode 28 equally applies to the other terminal electrodes 25 to 27 as mentioned above, the terminal electrode 28 will be described below.

As illustrated in FIG. 9, the terminal electrode 28 of the coil component 100 juts out from the mounting part 31 toward the depression 22 to form the wire holding part 33. With this configuration, the space provided by the depression 22 is occupied by the overhanging portion that extends from the mounting part 31 to the wire holding part 33 via the second bending part 32, the thickness of the metal sheet forming the terminal electrode 28, and the design tolerances of these portions.

Accordingly, it is an object of the present disclosure to provide a coil component that allows a terminal electrode to be placed by making effective use of a limited space provided by a depression provided in the flange portion of a substantially drum-shaped core, while also achieving reliable electrical connection and mechanical fixing between the terminal electrode and a wire.

According to one embodiment of the present disclosure, there is provided a coil component. First, the coil component includes a substantially drum-shaped core having a core part, and a flange provided on an end portion of the core part. The flange includes an inner end face facing toward the core part and where the end portion of the core part is positioned, an outer end face located opposite to the inner end face and facing outward, a bottom face that connects the inner end face with the outer end face, the bottom face being oriented toward a mount board when the coil component is mounted onto the mount board, a top face located opposite to the bottom face, and a pair of side faces, the side faces extending to connect the bottom face with the top face and being opposite to each other.

The coil component further includes a wire wound on the core part, and a terminal electrode electrically connected to an end portion of the wire and fixed to the flange.

The flange has a depression in an end portion of at least one of the side faces near the bottom face. The depression is in the form of a cutout defined by a substantially horizontal face extending along the bottom face and a substantially vertical face extending along the at least one of the side faces.

In the coil component, the terminal electrode includes (A) a base positioned on the outer end face of the flange, (B) a mounting part used to electrically connect the coil component to an electrically conductive part of the mount board, the mounting part extending from the base so as to be positioned above the bottom face of the flange via a first bending part that covers an edge portion where the outer end face and the bottom face meet, and (C) a wire connection part that extends from the base so as to be positioned above the substantially horizontal face via a second bending part that covers an edge portion where the outer end face and the substantially horizontal face meet, the wire connection part being electrically connected to the end portion of the wire.

According to the embodiment of the present disclosure, unlike in the case of Japanese Patent No. 5156076, the wire connection part of the terminal electrode, which is to be connected to the wire, extends not from the mounting part but from the base. The wire connection part is extended from the base to be positioned on the same side as the substantially horizontal face via the second bending part that covers the edge portion where the outer end face of each flange and the substantially horizontal face meet. This configuration allows for effective utilization of the space defined by the depression provided in the flange.

According to another embodiment of the present disclosure, the wire connection part includes a wire receiving part that extends along the substantially horizontal face from the base via the second bending part, and receives the end portion of the wire, and a wire welding part that extends from the distal end portion of the wire receiving part via a fold-back part such that the wire welding part overlaps the wire receiving part, the wire welding part being welded to the end portion of the wire. This configuration allows the wire connection part to have both the function of receiving and positioning the wire and the function of welding the wire. In particular, the wire receiving part (corresponding to the wire holding part 33 illustrated in FIGS. 8 and 9), which is subjected to positioning, and the wire welding part (corresponding to the wire welding part 35 illustrated in FIGS. 8 and 9), which is subjected to welding, face each other with respect to the plane direction, and aligned in their thickness direction. This allows for effective utilization of the limited space provided by the depression.

According to another embodiment of the present disclosure, when viewed in the direction perpendicular to the outer end face of the flange, the substantially vertical face has a length greater than the length of the substantially horizontal face. As described above, the wire connection part is extended from the base to be positioned on the same side as the substantially horizontal face via the second bending part that covers the edge portion where the outer end face of each flange and the substantially horizontal face meet. The above-mentioned configuration ensures that the wire connection part be placed within the space defined by the depression while allowing for a sufficient spatial margin by utilizing the longer of the above-mentioned two dimensions of the space.

According to another embodiment of the present disclosure, the wire connection part fits within the space defined by the depression. This configuration ensures that the wire connection part of the terminal electrode does not protrude beyond the outer contours of the coil component, thus minimizing an increase in the outer dimensions (mounting area) of the coil component due to the wire connection part.

The coil component according to the embodiments of the present disclosure allows a terminal electrode to be placed by making effective use of a limited space provided by a depression provided in the flange of a substantially drum-shaped core, while also achieving reliable electrical connection and mechanical fixing between the terminal electrode and a wire.

Other features, elements, characteristics and advantages of the present disclosure will become more apparent from the following detailed description with reference to the attached drawings.

BRIEF DESCRIPTION OF THE DRAWINGS

FIGS. 1A and 1B are perspective views of the outward appearance of a coil component according to a first embodiment of the present disclosure, of which FIG. 1A is a view seen from a relatively upper position above the coil component, and FIG. 1B is a view seen from a relatively lower position below the coil component.

FIGS. 2A to 2C illustrate the outward appearance of the coil component illustrated in FIGS. 1A and 1B, of which FIG. 2A is a front view, FIG. 2B is a bottom view, and FIG. 2C is a right side view.

FIGS. 3A to 3C illustrate the coil component illustrated in FIGS. 1A and 1B with an end portion of each wire being positioned on the wire receiving part of the corresponding terminal electrode, of which FIG. 3A is a front view, FIG. 3B is a bottom view, and FIG. 3C is a right side view.

FIGS. 4A to 4C illustrate the coil component illustrated in FIGS. 1A and 1B with an end portion of each wire being sandwiched between the wire receiving part and the wire welding part of the corresponding terminal electrode but not yet undergoing welding, of which FIG. 4A is a front view, FIG. 4B is a bottom view, and FIG. 4C is a right side view.

FIGS. 5A and 5B are perspective views of a coil component according to a second embodiment of the present disclosure, illustrating only a substantially drum-shaped core and terminal electrodes with an illustration of wires included in the coil component being omitted, of which FIG. 5A is a view seen from a relatively upper position above the coil component, and FIG. 5B is a view seen from a relatively lower position below the coil component.

DETAILED DESCRIPTION

Figure 1A:
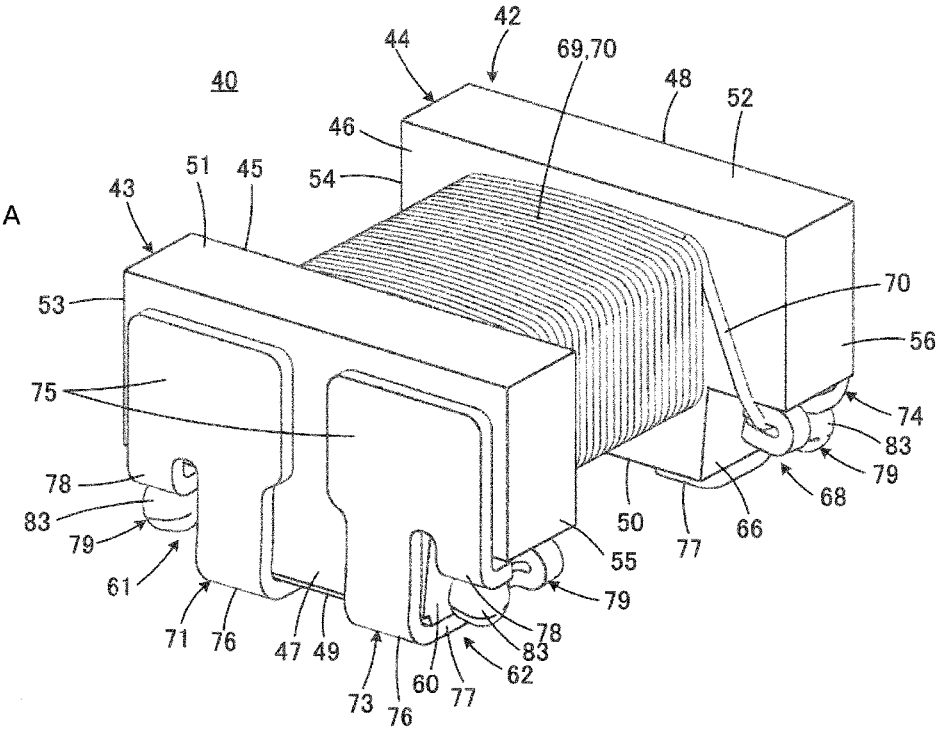
Figure 1B:
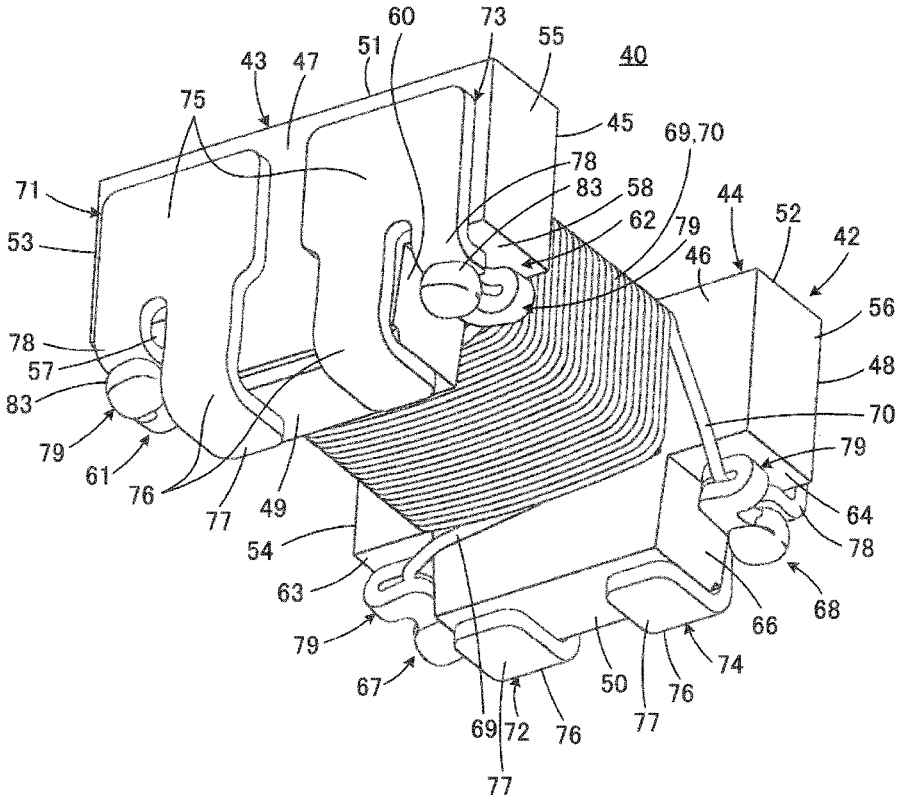

A coil component 40 according to a first embodiment of the present disclosure will be described with reference to FIG. 1A to FIG. 4C. More specifically, the coil component 40 illustrated in these figures form a common mode choke coil, which is an example of a coil component.

The coil component 40 includes a substantially drum-shaped core 42 that has a core part 41. The substantially drum-shaped core 42 includes first and second flanges 43 and 44 provided on end portions of the core part 41. The substantially drum-shaped core 42 is formed of, for example, a magnetic material such as ferrite. Although it is inferred from FIGS. 1A and 1B that the core part 41 has the shape of a substantially quadrangular prism, the core part 41 may alternatively have a substantially cylindrical or polygonal prism shape.

The flanges 43 and 44 respectively have inner end faces 45 and 46 facing toward the core part 41 and where both end portions of the core part 41 are positioned, and outer end faces 47 and 48 located opposite to the inner end faces 45 and 46 and facing outward. Further, the flanges 43 and 44 respectively have bottom faces 49 and 50 that are oriented toward a mount board (not illustrated) when the coil component 40 is mounted onto the mount board, top faces 51 and 52 located opposite to the bottom faces 49 and 50, first side faces 53 and 54, and second side faces 55 and 56 that are opposite to the first side faces 53 and 54.

In the first flange 43, the bottom face 49, the top face 51, the first side face 53, and the second side face 55 each connect the inner end face 45 with the outer end face 47. The first side face 53 and the second side face 55 extend so as to connect the bottom face 49 with the top face 51.

Likewise, in the second flange 44, the bottom face 50, the top face 52, the first side face 54, and the second side face 56 each connect the inner end face 46 with the outer end face 48. The first side face 54 and the second side face 56 extend so as to connect the bottom face 50 with the top face 52.

The first flange 43 has depressions 61 and 62 respectively located in end portions of the first and second side faces 53 and 55 near the bottom face 49. The depressions 61 and 62 are in the form of cutouts respectively defined by substantially horizontal faces 57 and 58 extending along the bottom face 49, and substantially vertical faces 59 and 60 extending along the side faces 53 and 55. The bottom face 49 and the substantially horizontal faces 57 and 58 may not necessarily be parallel. The side faces 53 and 55 and the substantially vertical faces 59 and 60 may not necessarily be parallel.

Likewise, the second flange 44 has depressions 67 and 68 respectively located in end portions of the first and second side faces 54 and 56 near the bottom face 50. The depressions 67 and 68 are in the form of cutouts respectively defined by substantially horizontal faces 63 and 64 extending along the bottom face 50, and substantially vertical faces 65 and 66 extending along the side faces 54 and 56. The bottom face 50 and the substantially horizontal faces 63 and 64 may not necessarily be parallel. The side faces 54 and 56 and the substantially vertical faces 65 and 66 may not necessarily be parallel. Specifically, for example, the substantially vertical faces 59, 60, 65, and 66 illustrated in FIGS. 1A to 4C have an inclination relative to the side faces 53, 54, 55, and 56 that corresponds to the draft angle used in the ferrite core molding process.

Figure 2A:
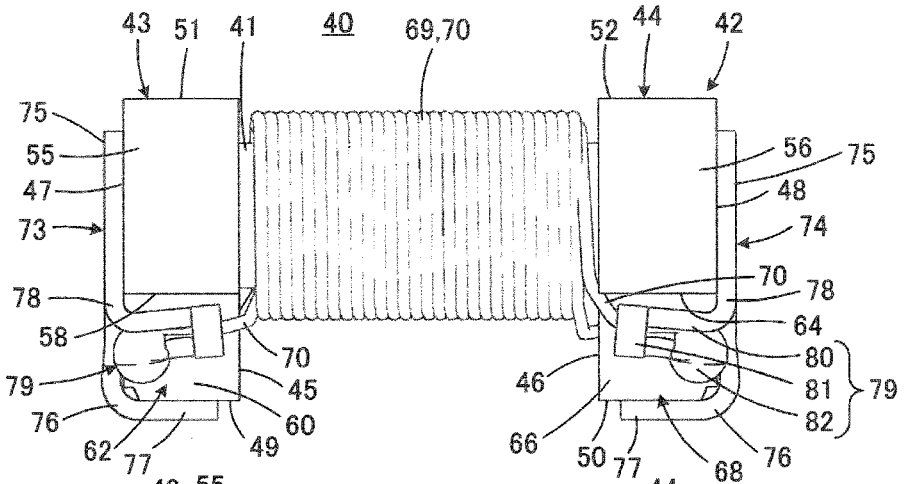
Figure 2B:
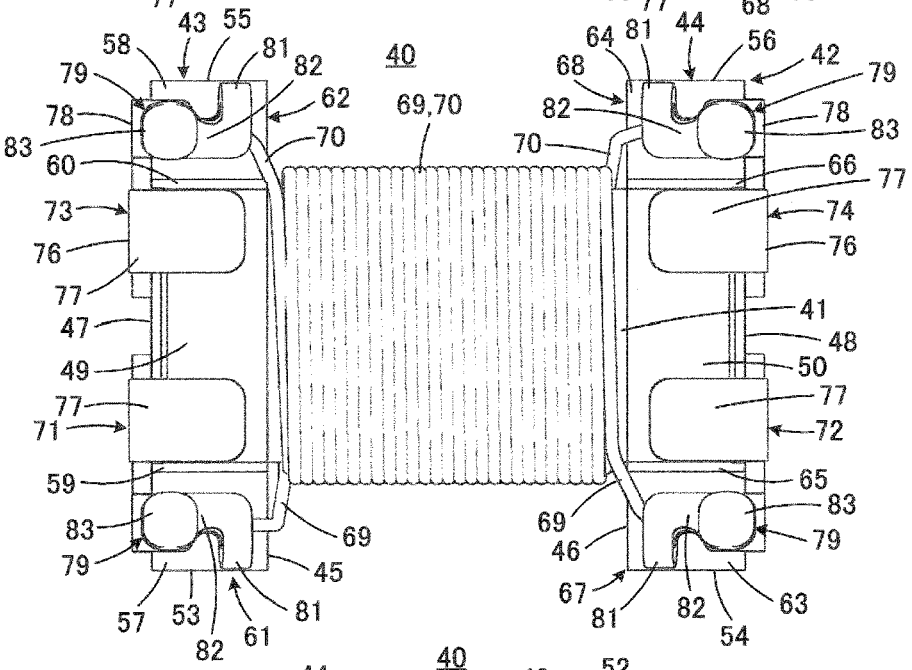
Figure 2C:
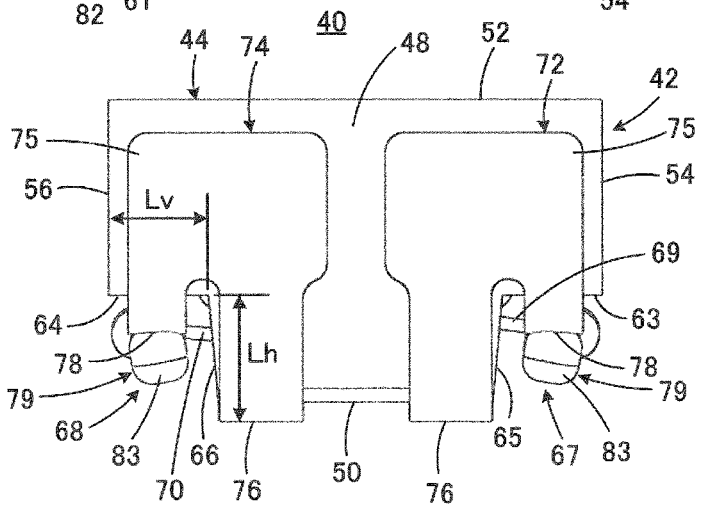

FIG. 2C depicts, in association with the depression 68, a length Lh of the substantially vertical face 66 and a length Lv of the substantially horizontal face 64 when viewed perpendicularly to the outer end face 48 of the flange 44. In the first embodiment, when viewed perpendicularly to the outer end faces 47 and 48 of the flanges 43 and 44, the length Lh of each of the substantially vertical faces 59, 60, 65, and 66 is greater than the length Lv of each of the substantially horizontal faces 57, 58, 63, and 64.

The coil component 40 further includes first and second wires 69 and 70 wound on the core part 41. The wires 69 and 70 are each formed of, for example, a copper wire with an insulating coating of resin such as polyurethane, polyester imide, or polyamidoimide.

If the coil component 40 is a common mode choke coil, the wires 69 and 70 are wound in the same direction. At this time, the wires 69 and 70 may be either wound in a two-layer fashion such that one of the wires is located on the inner layer side and the other is located on the outer layer side, or wound in a bifilar fashion such that the wires are arranged alternately and wound in parallel to each other in the axial direction of the core part 41.

The coil component 40 further includes first to fourth terminal electrodes 71 to 74. Among the first to fourth terminal electrodes 71 to 74, the first and third terminal electrodes 71 and 73 are fixed to the first flange 43 by using an adhesive. The second and fourth terminal electrodes 72 and 74 are fixed to the second flange 44 by using an adhesive.

The first terminal electrode 71 and the fourth terminal electrode 74 are substantially identical in shape, and the second terminal electrode 72 and the third terminal electrode 73 are substantially identical in shape. The first terminal electrode 71 and the third terminal electrode 73 are substantially plane symmetric, and the second terminal electrode 72 and the fourth terminal electrode 74 are substantially plane symmetric. Accordingly, one of the first to fourth terminal electrodes 71 to 74, for example, the third terminal electrode 73 will be described in detail below, and a detailed description of the first, second, and fourth terminal electrodes 71, 72, and 74 will not be provided.

Although the third terminal electrode 73 is normally manufactured by, for example, applying sheet metal working to a single metal sheet made of a copper-based alloy such as phosphor bronze or tough pitch copper, the third terminal electrode 73 may be manufactured by another method, for example, casting.

The third terminal electrode 73 includes a base 75 and a mounting part 77. The base 75 extends along the outer end face 47 of the flange 43. The mounting part 77 extends from the base 75 along the bottom face 49 of the flange 43 via a first bending part 76 that covers the edge portion where the outer end face 47 and the bottom face 49 of the flange 43 meet. That is, the base 75 is positioned on the outer end face 47 of the flange 43, and the mounting part 77 extends via the first bending part 76 so as to be positioned above the bottom face 49 of the flange 43.

Further, the terminal electrode 73 has a wire connection part 79 that extends from the base 75 via a second bending part 78. The wire connection part 79 includes a wire receiving part 80 and a wire welding part 82. The wire receiving part 80 extends along the substantially horizontal face 58 from the base 75 via the second bending part 78, and receives an end portion of the wire 70. The wire welding part 82 extends from the distal end portion of the wire receiving part 80 via a fold-back part 81 so as to overlap the wire receiving part 80, and is welded to an end portion of the wire. That is, the wire connection part 79 extends via the second bending part 78 so as to be positioned above the substantially horizontal face 58. The wire connection part 79 is positioned within the depression 62 provided in the first flange 43.

As described above, the wire connection part 79 may be provided with both the function of receiving and positioning the wire 70 and the function of welding the wire 70. In particular, in the wire connection part 79, the wire receiving part 80 and the wire welding part 82 have a positional relationship such that the wire receiving part 80 and the wire welding part 82 face each other with respect to the plane direction, and aligned in their thickness direction. In this case, within the space defined by the depression 62, the wire receiving part 80 and the wire welding part 82 can be broadened to the maximum extent in the plane direction, whereas in the thickness direction the wire receiving part 80 and the wire welding part 82 are overlapped to minimize broadening of these components. This configuration allows for more effective utilization of the space defined by the depression 62.

Reference signs 75, 76, 77, 78, 79, 80, 81, and 82 respectively used to designate the base, first bending part, mounting part, second bending part, wire connection part, wire receiving part, fold-back part, and wire welding part of the third terminal electrode 73 are also respectively used to designate the corresponding first bending part, mounting part, second bending part, wire connection part, wire receiving part, fold-back part, and wire welding part of each of the other terminal electrodes 71, 72, and 74.

One end of the first wire 69 is connected to the first terminal electrode 71, and the other end of the first wire 69 is connected to the second terminal electrode 72. One end of the second wire 70 is connected to the third terminal electrode 73, and the other end of the second wire 70 is connected to the fourth terminal electrode 74. As a representative example, the process of connecting the second wire 70 to the third terminal electrode 73 will be described below.

Figure 3A:
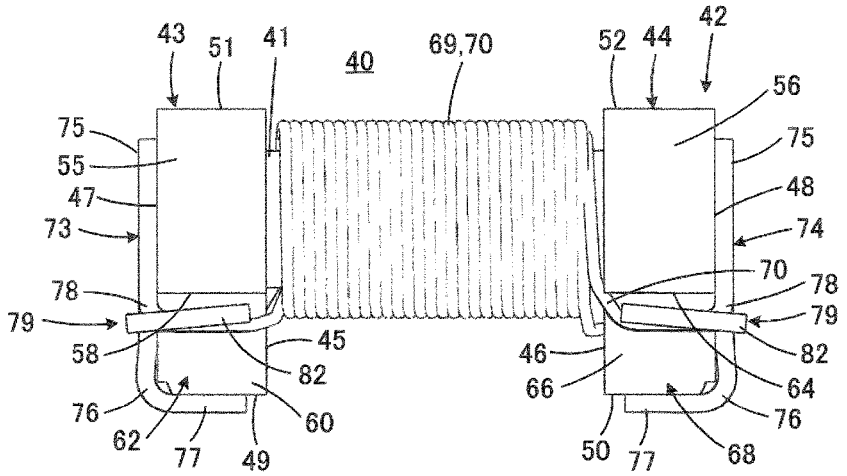
Figure 3B:
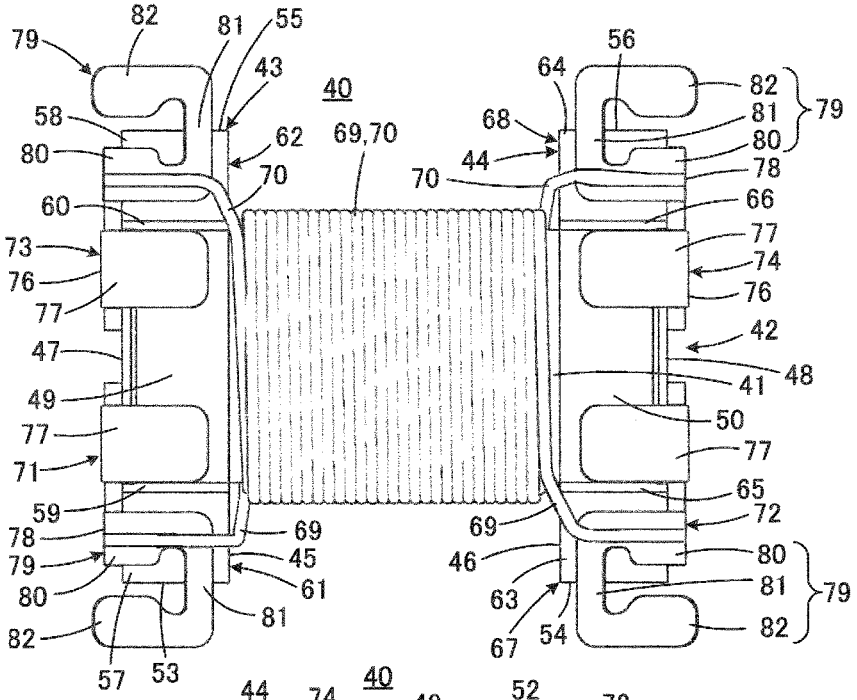
Figure 3C:
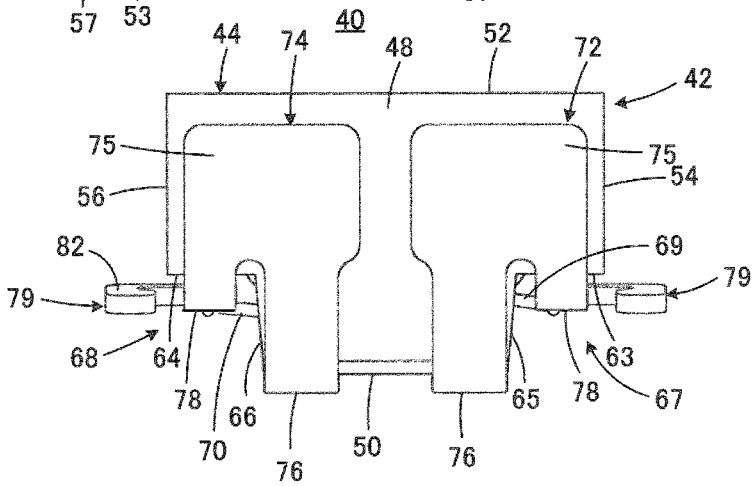

Prior to connection of the wire 70, the state of the terminal electrode 73 is such that as illustrated in FIGS. 3A to 3C, in the wire connection part 79, the wire welding part 82 is unfolded with respect to the wire receiving part 80. In this state, an end portion of the wire 70 is positioned on the wire receiving part 80 of the terminal electrode 73.

Next, the wire 70 is temporarily fixed to the wire receiving part 80. For example, the insulating coating on the wire 70 is heated to soften, followed by application of a load to the resulting insulating coating. This brings the wire 70 into close contact with the wire receiving part 80, thus temporarily fixing the wire 70 to the wire receiving part 80.

Next, the wire 70 is irradiated with a laser beam to remove the insulation coating in the portion of the wire 70 opposite to the area in close contact with the wire receiving part 80, thus exposing the wire 70.

Figure 4A:
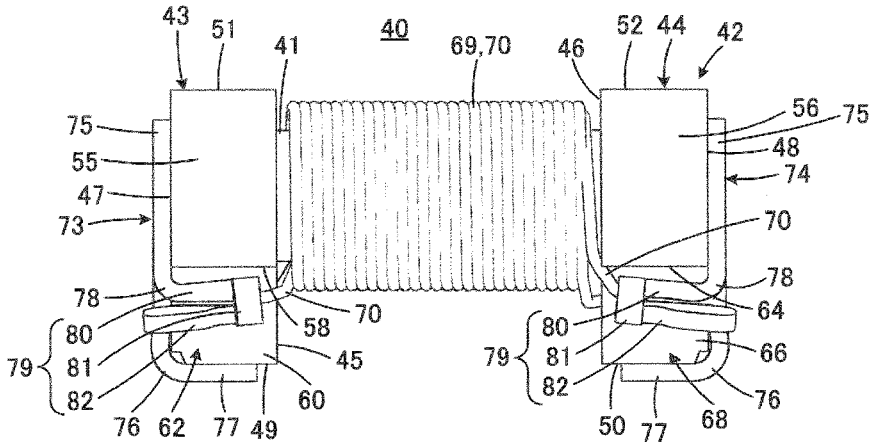
Figure 4B:
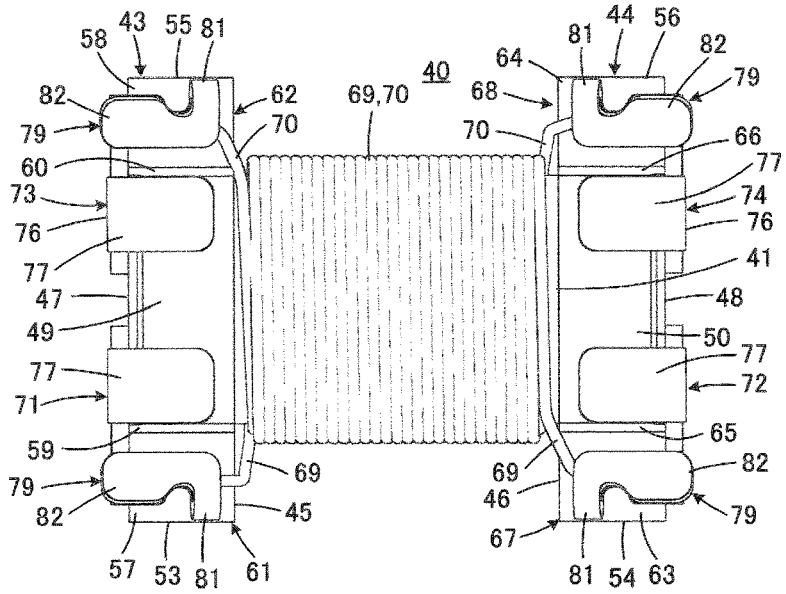
Figure 4C:
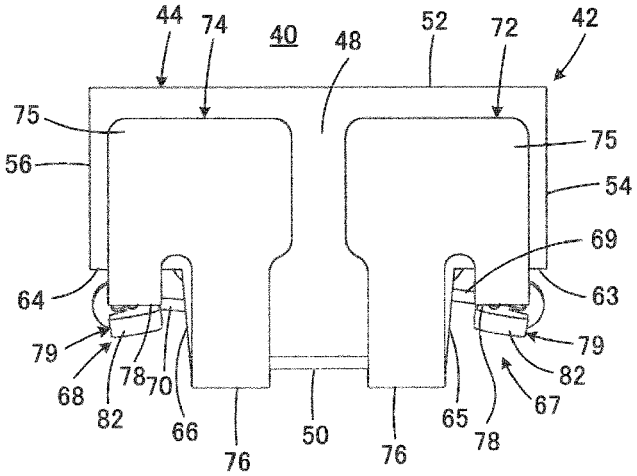

Next, as illustrated in FIGS. 4A to 4C, the fold-back part 81 is folded such that the wire welding part 82 faces and overlaps the wire receiving part 80 with the end portion of the wire 70 interposed therebetween, thus bringing the exposed copper wire into close contact with the fold-back part 81.

Next, a laser beam is applied to the wire welding part 82, thus welding the wire welding part 82 and the end portion of the wire 70 together. A weld ball 83 formed as a result of this laser welding is illustrated in FIGS. 1A to 2C.

The process of connecting the second wire 70 to the third terminal electrode 73 is completed as described above. The same process is performed for the first, second, and fourth terminal electrodes 71, 72, and 74 to complete the coil component 40 illustrated in FIGS. 1A to 2C. Although laser welding is used for the connection between the wire welding part 82 and the wire 70 in the foregoing description, this is not to be construed respectively. Other methods such as arc welding may be used for the connection.

In the coil component 40, the respective wire connection parts 79 of the terminal electrodes 71 to 74, which each include the wire receiving part 80 and the wire welding part 82, fit within the spaces defined by the depressions 61, 67, 62, and 68 while achieving reliable electrical connection and mechanical fixing between the wires 69 and 70 and the terminal electrodes 71 to 74.

In particular, in the first embodiment, the length Lh of each of the substantially vertical faces 59, 60, 65, and 66 is greater than the length Lv of each of the substantially horizontal faces 57, 58, 63, and 64 as described above. This allows the wire connection part 79 to be placed within the space defined by each of the depressions 61, 62, 67, and 68 while allowing for a sufficient spatial margin by utilizing the longer of the above-mentioned two dimensions of the space. Specifically, in the coil component 40, the wire receiving part 80, the wire 70, and the wire connection part 79 become aligned along the substantially vertical faces 59, 60, 65, and 66. Therefore, an increase in volume due to these parts occurs along the length Lh, which is the longer of the two lengths, thus allowing for a sufficient spatial margin in placing the wire connection part 79. If such an advantage is not particularly desired, the length Lh may be substantially equal to or shorter than the length Lv.

As described above, from the viewpoint of reducing the size of the coil component 40, the wire connection part 79 preferably fits within the space defined by the corresponding one of the depressions 61, 67, 62, and 68. However, if such an advantage is allowed to be diminished, the wire connection part 79 may partially extend off the above-mentioned space.

Figure 5A:
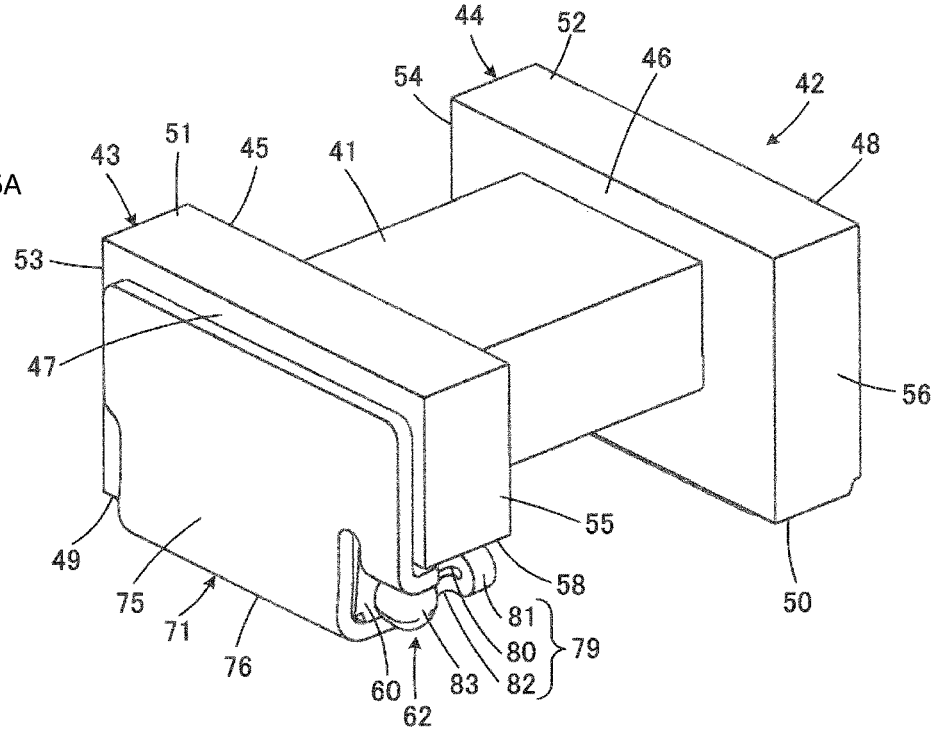
Figure 5B:
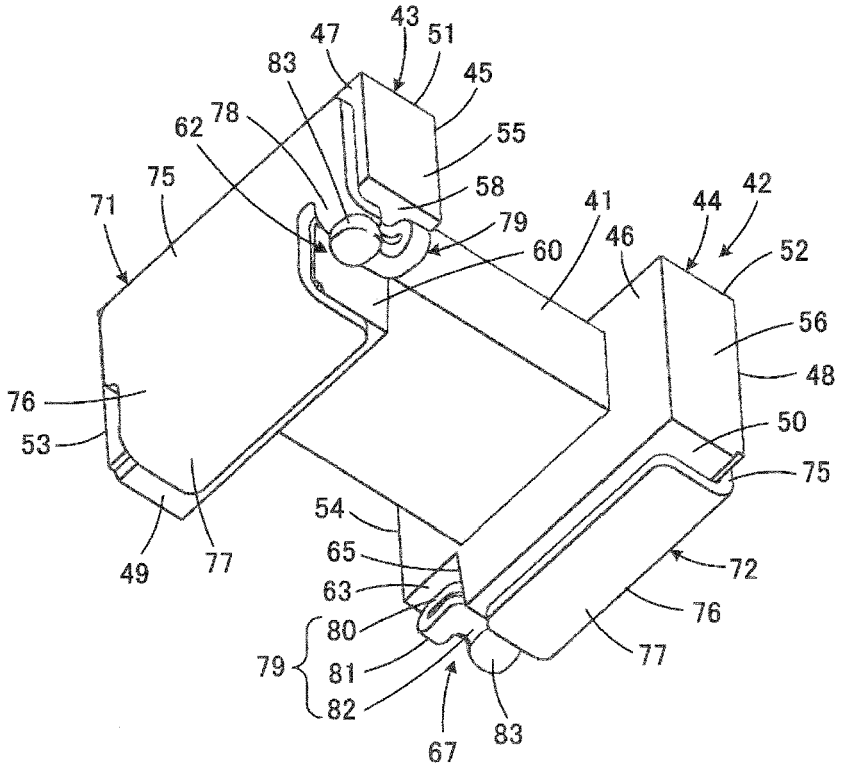

Next, a coil component according to a second embodiment of the present disclosure will be described with reference to FIGS. 5A and 5B. In FIGS. 5A and 5B, wires are not illustrated, and only the substantially drum-shaped core 42 and the terminal electrodes 71 and 72 of the coil component are depicted. In FIGS. 5A and 5B, elements corresponding to the elements illustrated in FIGS. 1A to 4C are denoted by the same reference signs to avoid repetitive description.

The coil component according to the second embodiment, which constitutes a typical coil, includes a single terminal electrode provided for each of the first and second flanges 43 and 44, that is, a total of two terminal electrodes 71 and 72, and a single wire (not illustrated).

More specifically, the first flange 43 has the depression 62 in an end portion of the side face 55 near the bottom face 49. The depression 62 is in the form of a cutout defined by the substantially horizontal face 58 extending along the bottom face 49 and the substantially vertical face 60 extending along the side face 55.

Likewise, the second flange 44 has the depression 67 in an end portion of the side face 54 near the bottom face 50. The depression 67 is in the form of a cutout defined by the substantially horizontal face 63 extending along the bottom face 50 and the substantially vertical face 65 extending along the side face 54.

The coil component according to the second embodiment further includes the first and second terminal electrodes 71 and 72. The first terminal electrode 71 is fixed to the first flange 43 by using an adhesive. The second terminal electrode 72 is fixed to the second flange 44 by using an adhesive.

The first terminal electrode 71 includes the base 75 and the mounting part 77. The base 75 extends along the outer end face 47 of the flange 43. The mounting part 77 extends from the base 75 along the bottom face 49 of the flange 43 via the first bending part 76 that covers the edge portion where the outer end face 47 and the bottom face 49 of the flange 43 meet. Further, the terminal electrode 71 has the wire connection part 79 that extends from the base 75 via the second bending part 78. The wire connection part 79 includes the wire receiving part 80 and the wire welding part 82. The wire receiving part 80 extends along the substantially horizontal face 58 from the base 75 via the second bending part 78, and receives an end portion of the wire. The wire welding part 82 extends from the distal end portion of the wire receiving part 80 via the fold-back part 81 so as to overlap the wire receiving part 80. The wire welding part 82 is to be welded to an end portion of the wire. The wire connection part 79 is positioned within the depression 62 provided in the first flange 43.

The first terminal electrode 71 and the second terminal electrode 72 are substantially identical in shape. Accordingly, reference signs 75, 76, 77, 78, 79, 80, 81, and 82 respectively used to designate the base, first bending part, mounting part, second bending part, wire connection part, wire receiving part, fold-back part, and wire welding part of the first terminal electrode 71 are also respectively used to designate the corresponding first bending part, mounting part, second bending part, wire connection part, wire receiving part, fold-back part, and wire welding part of the second terminal electrode 72.

The second terminal electrode 72 includes the base 75 and the mounting part 77. The base 75 extends along the outer end face 48 of the flange 44. The mounting part 77 extends from the base 75 along the bottom face 50 of the flange 44 via the first bending part 76 that covers the edge portion where the outer end face 48 and the bottom face 50 of the flange 44 meet. Further, the terminal electrode 72 has the wire connection part 79 that extends from the base 75 via the second bending part 78 (not illustrated in FIGS. 5A and 5B). The wire connection part 79 includes the wire receiving part 80 and the wire welding part 82. The wire receiving part 80 extends along the substantially horizontal face 63 from the base 75 via the second bending part 78, and receives an end portion of the wire. The wire welding part 82 extends from the distal end portion of the wire receiving part 80 via the fold-back part 81 so as to overlap the wire receiving part 80. The wire welding part 82 is to be welded to an end portion of the wire. The wire connection part 79 is positioned within the depression 67 provided in the second flange 44.

One end portion of the wire (not illustrated) is connected to the wire connection part 79 of the first terminal electrode 71 provided in the first flange 43, more specifically, to the wire welding part 82 by, for example, laser welding. Likewise, the other end portion of the wire is connected to the wire connection part 79 of the second terminal electrode 72 provided in the second flange 44, more specifically, to the wire welding part 82 by, for example, laser welding. In FIGS. 5A and 5B, although the wire is not illustrated, the weld ball 83 formed as a result of this laser welding is depicted.

Figure 6:
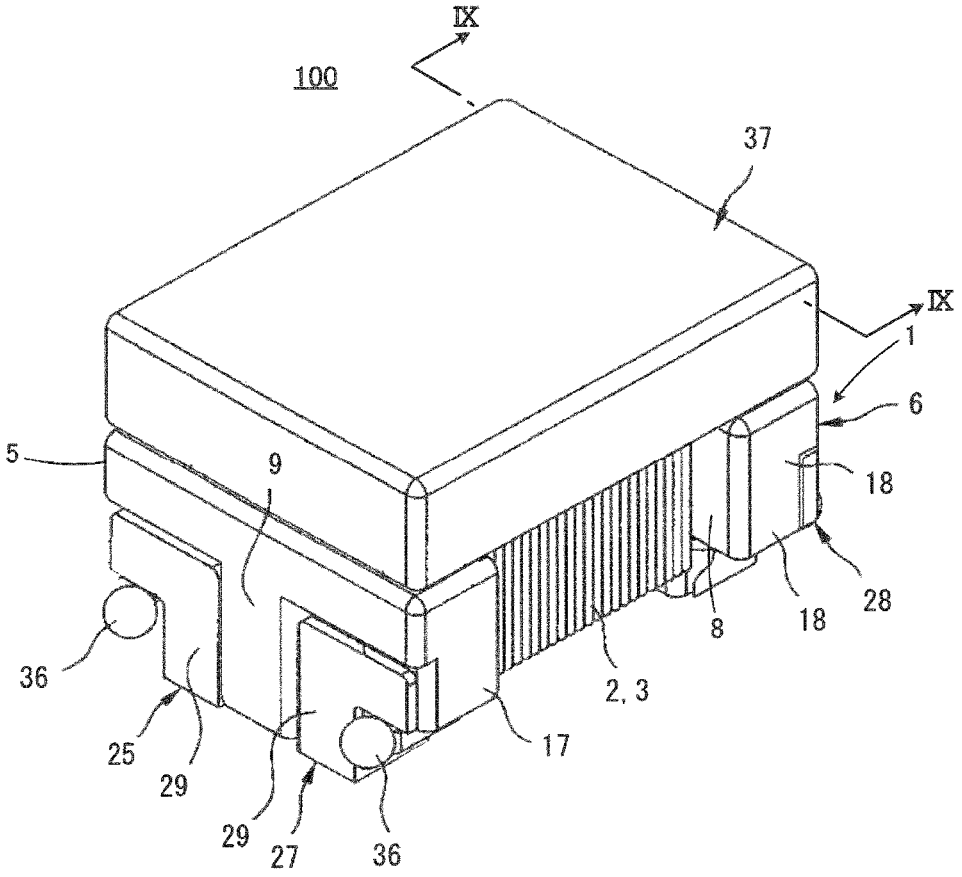
FIG. 6 is a perspective view of the outward appearance of a coil component described in Japanese Patent No. 5156076.
Figure 7:
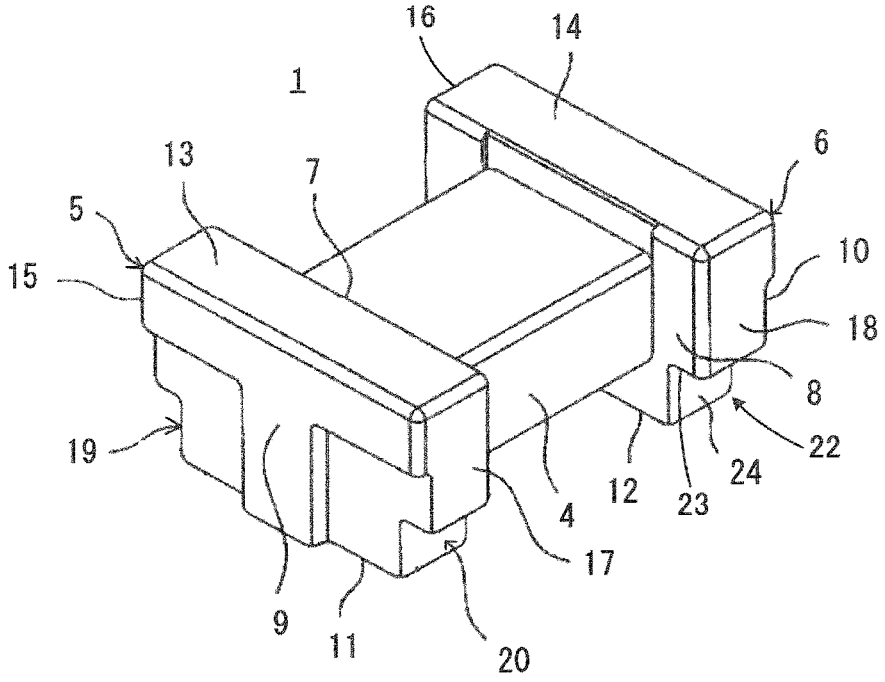
FIG. 7 is a perspective view, as depicted alone, of the substantially drum-shaped core of the coil component illustrated in FIG. 6.
Figure 8:
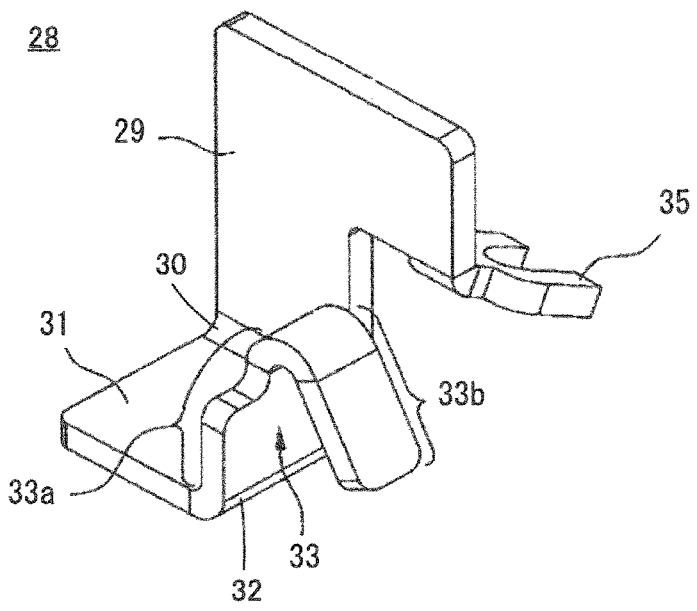
FIG. 8 is a perspective view, as depicted alone, of a terminal electrode included in the coil component illustrated in FIG. 6.
Figure 9:
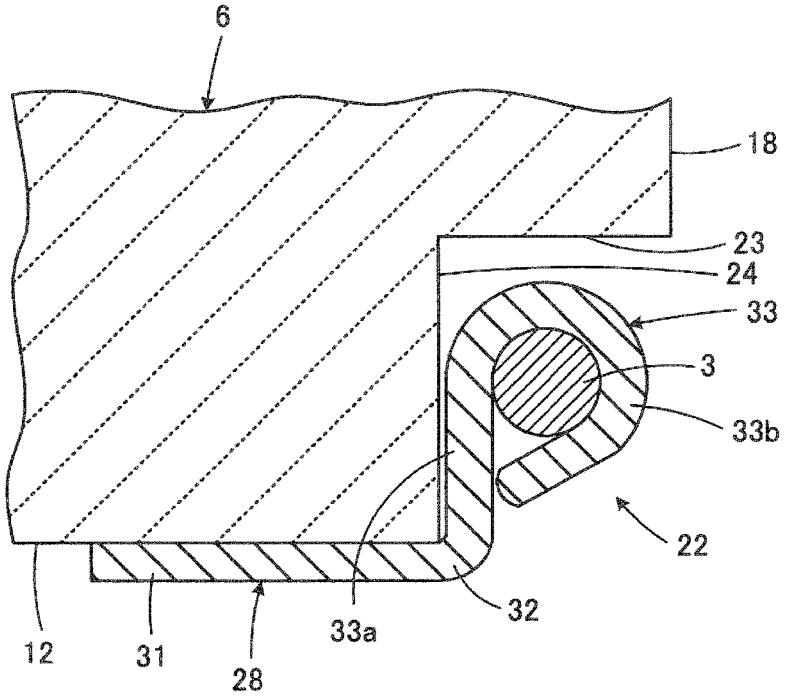
FIG. 9 is an enlarged cross-sectional view, taken along a line IX-IX in FIG. 6, of a flange, a terminal electrode, and a wire of the coil component illustrated in FIG. 6.

Although the plate core 37 illustrated in FIG. 6 is not mentioned in the foregoing description of the embodiments, the coil component according to the above embodiments of the present disclosure may be provided with a plate core.

Although the coil component according to specific embodiments of the present disclosure has been described above, it is to be noted that the embodiments mentioned above are for illustrative purposes only, and structural portions in different embodiments may be substituted for or combined with each other.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A coil component comprising:

a substantially drum-shaped core having a core part, and a flange provided on an end portion of the core part, the flange including an inner end face facing toward the core part and where the end portion of the core part is positioned, an outer end face located opposite to the inner end face and facing outward, a bottom face that connects the inner end face with the outer end face, the bottom face being oriented toward a mount board when the coil component is mounted onto the mount board, a top face located opposite to the bottom face, and a pair of side faces, the side faces extending to connect the bottom face with the top face and being opposite to each other;

a wire wound on the core part; and a terminal electrode electrically connected to an end portion of the wire and fixed to the flange, wherein the flange has a depression in an end portion of at least one of the side faces near the bottom face, the depression being in a form of a cutout defined by a substantially horizontal face extending along the bottom face and a substantially vertical face extending along the at least one of the side faces, and wherein the terminal electrode includes a base positioned on the outer end face of the flange, a first arm and a second arm, each of the first arm and the second arm having a first portion extending from the base along the outer end face of the flange towards the bottom face of the flange and a second portion extending from the first portion along the bottom face of the flange, the first arm and the second arm being provided at a spaced distance apart from each other with a gap therebetween, the second portion of the first arm being a mounting part used to electrically connect the coil component to an electrically conductive part of the mount board, the mounting part extending from the base so as to be positioned to cover a portion of the bottom face of the flange via a first bending part of the terminal electrode that covers an edge portion where the outer end face and the bottom face meet, and the second portion of the second arm being a wire connection part that extends from the base so as to be positioned to cover a portion of the substantially horizontal face via a second bending part of the terminal electrode that covers an edge portion where the outer end face and the substantially horizontal face meet, the wire connection part being electrically connected to the end portion of the wire.

2. The coil component according to claim 1, wherein the wire connection part includes a wire receiving part that extends along the substantially horizontal face from the base via the second bending part, and receives the end portion of the wire, and a wire welding part that extends from a distal end portion of the wire receiving part via a fold-back part such that the wire welding part overlaps the wire receiving part, the wire welding part being welded to the end portion of the wire.

3. The coil component according to claim 1, wherein when viewed in a direction perpendicular to the outer end face of the flange, the substantially vertical face has a length greater than a length of the substantially horizontal face.

4. The coil component according to claim 1, wherein the wire connection part fits within a space defined by the depression.

* * * * *